United States Patent [19]

Hayward

[11] Patent Number: 5,024,167

[45] Date of Patent: Jun. 18, 1991

[54] DESK SYSTEM

[75] Inventor: James E. Hayward, Richmond Hill, Canada

[73] Assignee: Innovative Metal Inc., Rexdale, Canada

[21] Appl. No.: 350,812

[22] Filed: May 12, 1989

[51] Int. Cl.[5] ..... A47B 35/00

[52] U.S. Cl. ..... 108/50; 312/195

[58] Field of Search ..... 108/50, 159, 157, 154, 108/153, 111, 42; 312/195, 196, 208, 223

[56] References Cited

U.S. PATENT DOCUMENTS

| | | | |
|---|---|---|---|
| 3,004,814 | 10/1961 | Schulze | 108/159 X |
| 3,883,202 | 5/1975 | Konig | 312/195 X |
| 4,050,752 | 9/1977 | Dykstra | 312/195 X |
| 4,094,256 | 6/1978 | Holper et al. | 108/50 |
| 4,170,181 | 10/1979 | Glasgow | 108/50 |
| 4,433,630 | 2/1984 | Laborie | 108/50 |
| 4,612,863 | 9/1986 | Vonhausen et al. | 108/50 X |
| 4,639,049 | 1/1987 | Frascaroli et al. | 312/195 |
| 4,711,184 | 12/1987 | Wallin et al. | 108/144 |
| 4,792,881 | 12/1988 | Wilson et al. | 312/123 X |

FOREIGN PATENT DOCUMENTS

| | | | |
|---|---|---|---|
| 0006707 | 1/1980 | European Pat. Off. | 108/50 |

*Primary Examiner*—José V. Chen

*Attorney, Agent, or Firm*—Rogers, Bereskin & Parr

[57] ABSTRACT

An office desk system or work station is based on a structural supporting frame or chassis made up of two spaced parallel end gables and a beam extending between the gables at the rear edge of a work top. Each gable is a welded assembly of steel channels and the beam is a steel generally box section member. Decorative cladding is attached to the frame to provide the desk with the required external appearance. The beam has two internal wiring channels so that electrical power and telecommunication services can be provided directly at the work surface of the desk. Disconnectable couplings are provided between the beam and gables and each gable is provided with several coupling points so that many different desk system or work station configurations can be assembled from the same basic components.

14 Claims, 8 Drawing Sheets

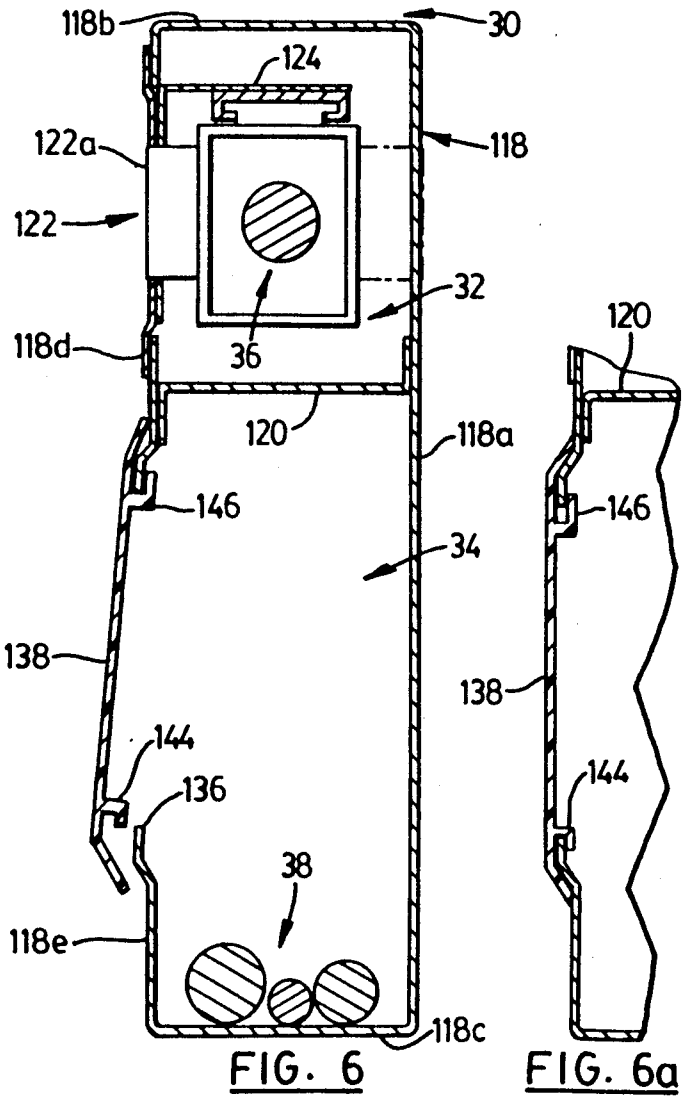
FIG. 6a
FIG. 6
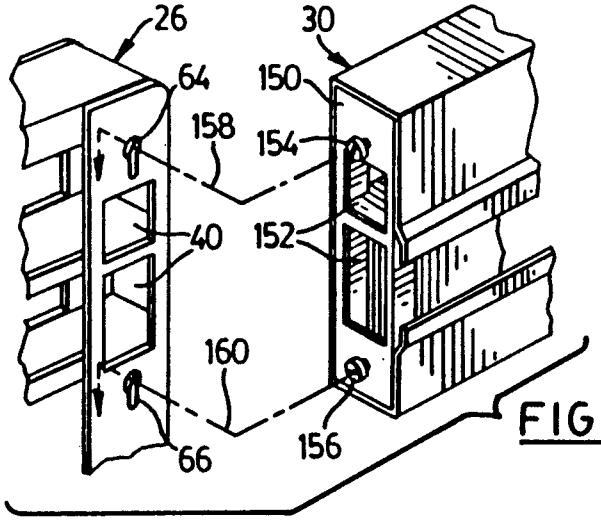
FIG. 5
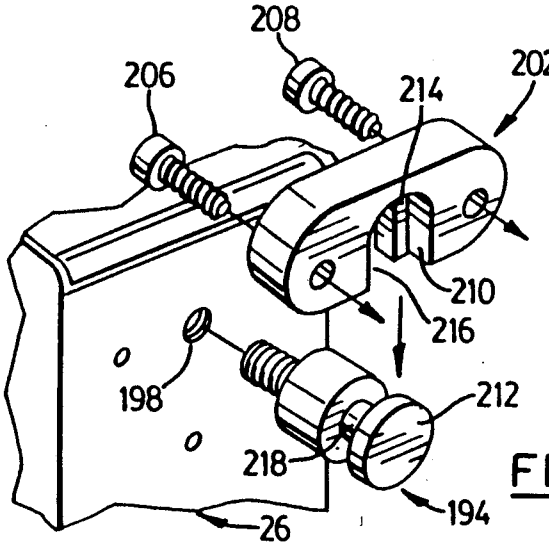
FIG. 7a

DESK SYSTEM

FIELD OF THE INVENTION

This invention relates generally to office furniture and is concerned more particularly with a desk that can be used as the basis for an office work station or a system of interconnected desks.

BACKGROUND OF THE INVENTION

Traditional office furniture design has for many years been based on a concept known as "the wall". Essentially, this concept relies on the use of walls or partitions for defining the configuration of the office; work tops and accessories such as filing cabinets, racks, drawers, etc. are supported from the walls or partitions. While work station designs based on this concept have been widely used in practice, such designs have inherent limitations in terms of flexibility. Walls or partitions must be used throughout the entire desk system eve where they may not otherwise be required. In other words, the essential requirement for walls or partitions at least to some extent dictates the overall form of the desk system.

European Patent Application No. 79301116.4 (Publication No. 6707)—Hauserman discloses an example of an office furniture system based on the "wall" concept.

U.S. Pat. No. 4,748,913 (Favaretto and Hayward) discloses a desk system which represents a radical and fundamental departure from the "wall" concept. The Favaretto et al. invention employs the desk as the essential element of the furniture system and relies on the desk to support partitions, screens and other accessories. The desk design disclosed in the patent allows a number of similar desks to be linked together to define the configuration of the office. The desk incorporates wiring that can be used to bring power, telecommunication and data services to the individual locations on the desks where these services are used. A desk system of the form disclosed in the Favaretto et al. patent has been marketed successfully for some years by the assignee of the present invention, under the trade mark POWER-BEAM.

SUMMARY OF THE INVENTION

An object of the present invention is to provide a novel form of desk that can be used as the central element of an office furniture system.

The desk provided by the present invention includes a work top having a work surface and a structural frame supporting the work top. The frame includes a pair of spaced parallel gables and at least one beam that extends between the gables at an outer edge of the desk. Each gable has the form of a rigid structural unit including front and rear uprights, and is adapted to permit attachment thereto of decorative cladding means. Disconnectable coupling means is provided between respective ends of the beam and the gables. The coupling means structurally connect the beam and the gables. The beam defines at least two wiring channels which extend from end-to-end of the beam and which are electrically screened from one another. The channels are adapted to receive respective wiring sets and to permit access to said sets from a front face of the beam. The gables further include openings permitting communication with ends of the wiring channels from externally of the respective gables.

The structural frame of the desk forms a rigid base or "chassis" for supporting the other components of the desk. The essential components of that frame are the pair of end gables, each a rigid structural unit, and the beam rigidly coupled between the gables. Preferably, the gables are welded metal frames. The beam can be basically a box or channel-section fabrication provided with apertured end plates that carry relevant parts of the coupling means between the beam and gables. The fact that the beam and gables are disconnectable allows a variety of configurations to be construction, as will be described in more detail later.

Where screens, partitions or other accessories are required in the desk system, they can be hung directly from the structural frame, preferably from the end gables of the frame. For example, a desk can be provided with a screen comprising a pair of upright posts and a series of screen panels extending horizontally between the posts. Lower end portions of the posts can be coupled to rear edge faces of the respective gables, again as will be described in more detail later.

BRIEF DESCRIPTION OF THE DRAWINGS

In order that the invention may be more clearly understood, reference will now be made to the accompanying drawings which illustrate a particular preferred embodiment of the invention by way of example, and in which:

FIG. 5 is a detail perspective view generally in the direction of arrow 5 in FIG. 3, illustrating the coupling means between the beam and gable;

FIG. 6 is a sectional view on line 6—6 of FIG. 3 showing the beam assembled;

FIG. 6*a* is a detail view corresponding to part of FIG. 6 showing a trim cover plate in a fully closed position;

FIG. 7*a* is a perspective view in the direction of arrow 7*a* in FIG. 7 and illustrates the coupling means between a post of the screen and the desk;

DESCRIPTION OF THE PREFERRED EMBODIMENT

Figure 1:
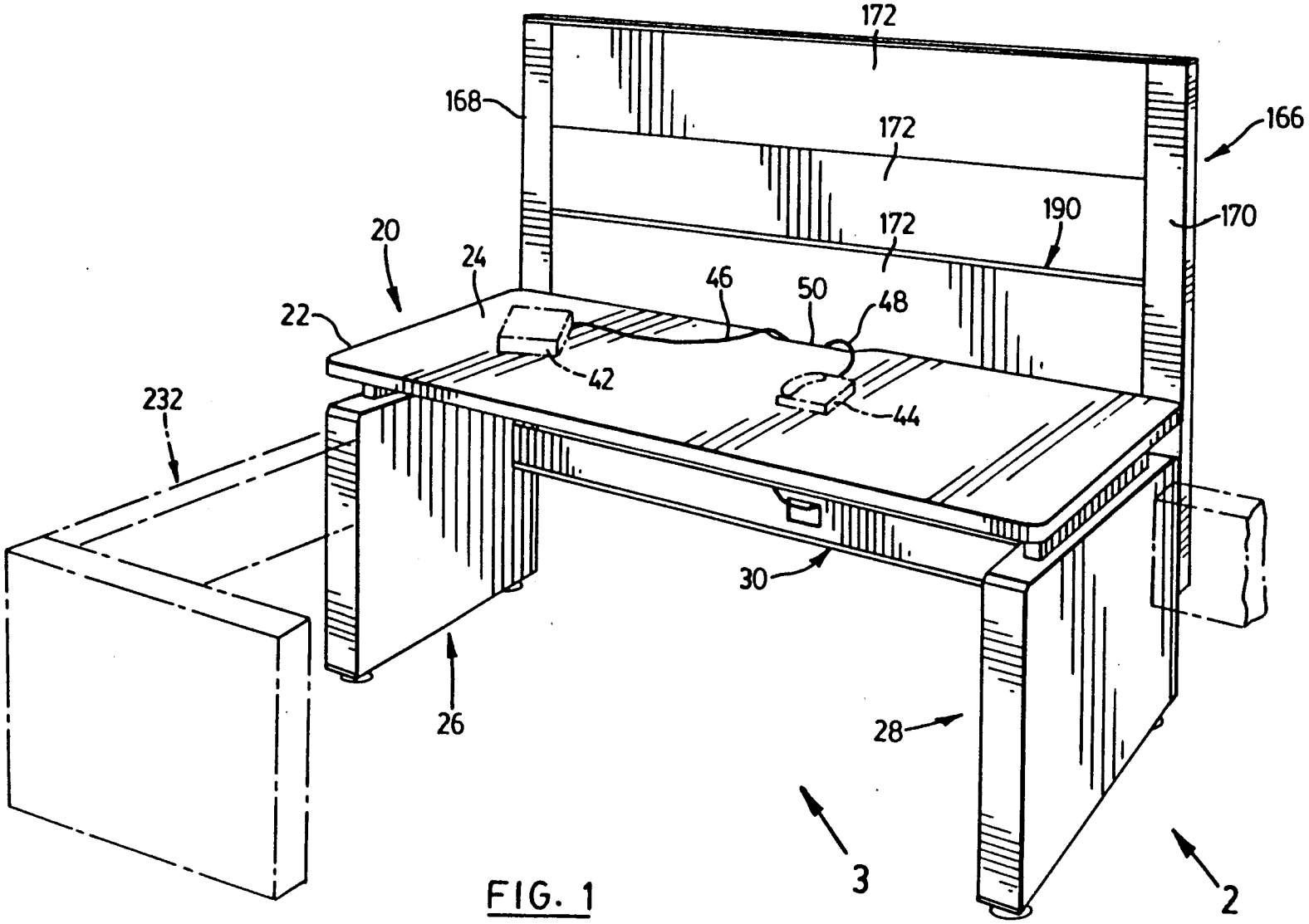
FIG. 1 a perspective view of an assembled desk and screen.
Figure 2:
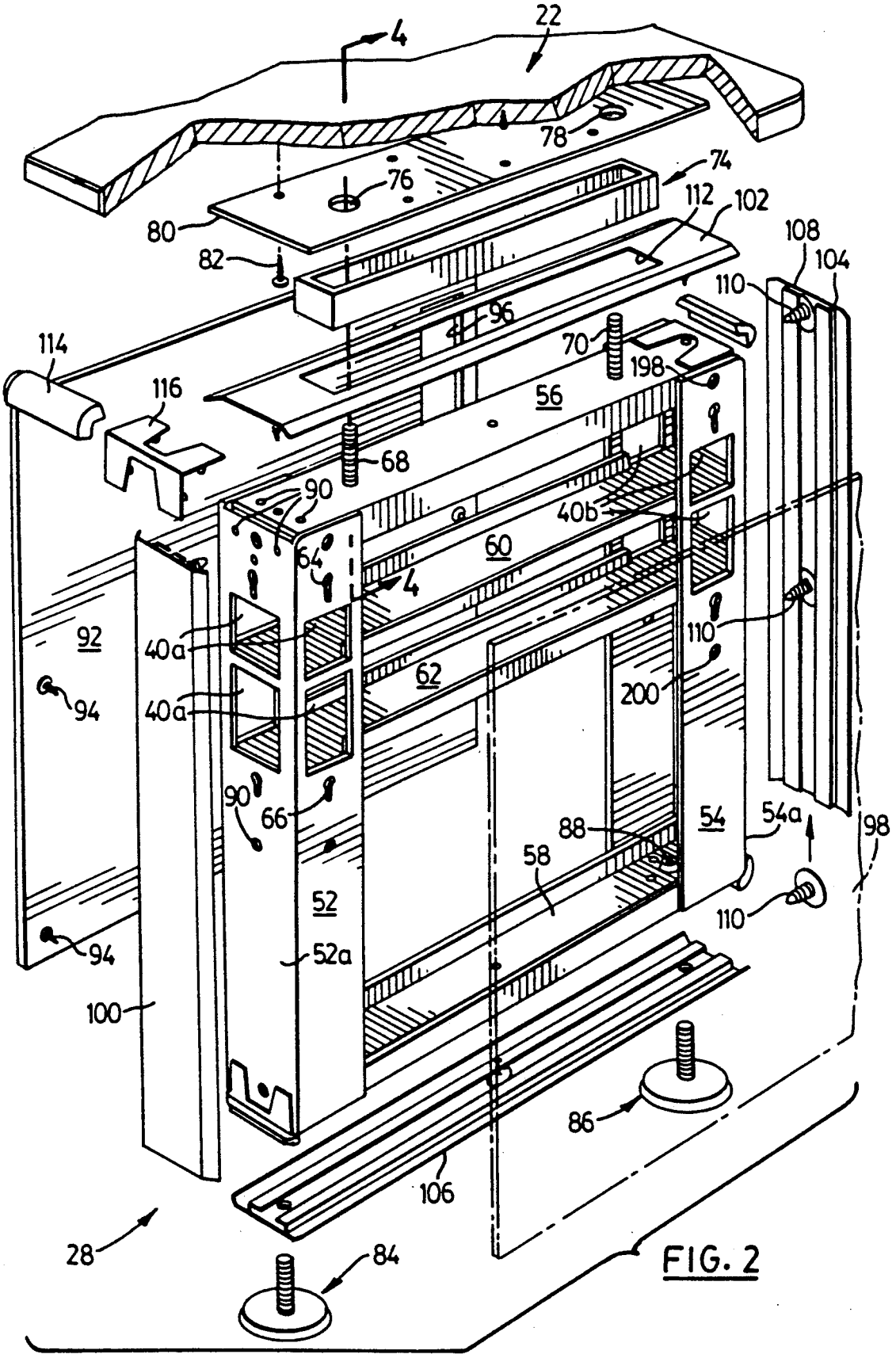
FIG. 2 is a perspective view generally in the direction of arrow 2 in FIG. 1 showing one of the end gables of the desk in partly exploded form.
Figure 3:
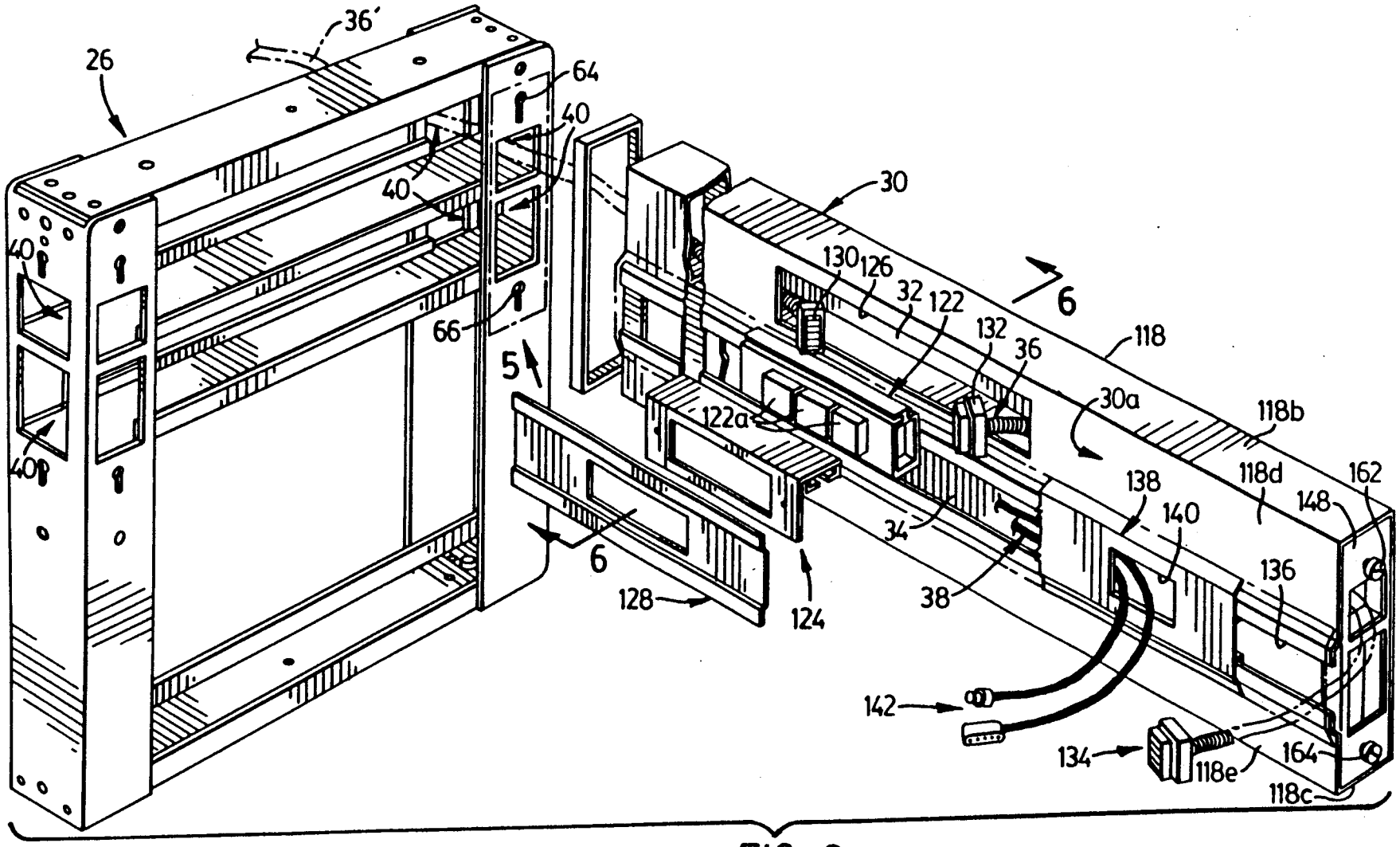
FIG. 3 is a similar view in the direction of arrow 3 in FIG. 1 showing the other gable and the beam.

Referring first to FIG. 1, a desk is generally indicated by reference numeral 20 and includes a work top 22 having a work surface 24. The work top is supported by a structural frame which is best illustrated in FIGS. 2 and 3 and most of which is concealed by cladding in FIG. 1. However, FIG. 1 does show generally a pair of end gables 26 and 28 and a beam 30 or "power track" that extends between the gables at the rear side of the desk. As will be described in more detail later, the beam and gables are connected by disconnectable coupling means between the ends of the beam and the inner sides of the gables, which structurally connect the beam and gables. Various different combinations of gables and beams can be assembled to form different desk arrangements, permitting flexibility of work station layout.

As best seen in FIG. 3, beam 30 defines upper and lower wiring channels, 32 and 34 which extend from end to end of the beam. The channels are electrically screened from one another and, in the assembled desk, receive respective wiring sets. In the preferred embodiment illustrated, the upper channel 32 receives electrical power wiring set 36 while the lower channel 34 receives computer and telecommunication wiring sets indicated at 38. Electrical screening is provided by a solid wall of the beam between the two channels, as will be described later. FIG. 3 also shows openings in end gable 26 that permit communication from externally of the gable with the wiring channels within member 30. Those openings are generally indicated by reference numeral 40. It will be seen that two sets of openings are provided and are aligned generally with the two wiring channels 32, 34 in member 30. In FIG. 3, part of the electrical wiring set 36 is shown in ghost outline at 36' extending through upper openings in gable 36 that are aligned with channel 32.

The beam provides access to the wiring sets through the front face 30*a* of member 30 as will be described so that power and telecommunication services can be brought directly to the work top 22. In FIG. 1, electrical devices are shown on the work top in ghost outline at 42 and 44 respectively and are connected by cables 46 and 48 respectively to the wiring sets within beam 30. Device 42 may be, for example, an adding or dictating machine while device 44 could be a telephone. It will be seen that the rear edge of work top 22 is recessed at 50 to accommodate the cables.

Reference will now be made to FIG. 2 in describing in detail the structure of gable 28. Gable 26 is identical. Gable 28 is a rigid structural unit assembled from relatively heavy gauge steel components that are welded together. These components include identical front and rear uprights 52 and 54 in the form of channel members that are arranged in inwardly facing positions. Respective top and bottom channel members 56 and 58 extend between and are welded at their ends to the uprights 52 and 54. Each of the uprights is provided in each of its side limbs and in its base with a pair of rectangular openings (40) for accommodating electrical wiring as discussed previously in connection with FIG. 3. In FIG. 2, the wiring access openings are indicated at 40*a* in the case of upright 52 and at 40*b* in the case of upright 54. The openings in the side limbs of the channel members allow wiring to be led through the gable in a direction at right angles to a plane containing the gable while the openings in the end faces (the faces denoted 52*a* and 54*a* in FIG. 2) allow wiring to be led generally in a direction parallel to a said plane containing the gable (from front to back of an assembled desk). Shallow channel members 60 and 62 extend in this direction parallel to the top and bottom members 56 and 58 and are spaced vertically in relation to the openings 40*a* and 40*b* for supporting wiring installed in this latter direction.

Keyhole openings indicated at 64 and 66 are provided one above and one below each pair of openings 40*a* or 40*b* in each of the side limbs and base of each upright 52, 54. These keyhole openings form part of the coupling means between the beam and the gable as will be described. It will be appreciated that, by providing keyhole openings and wiring access openings in all three faces of each upright, a beam (or its equivalent) can be coupled to any one of those faces depending on the particular desk configuration required.

Figure 4:
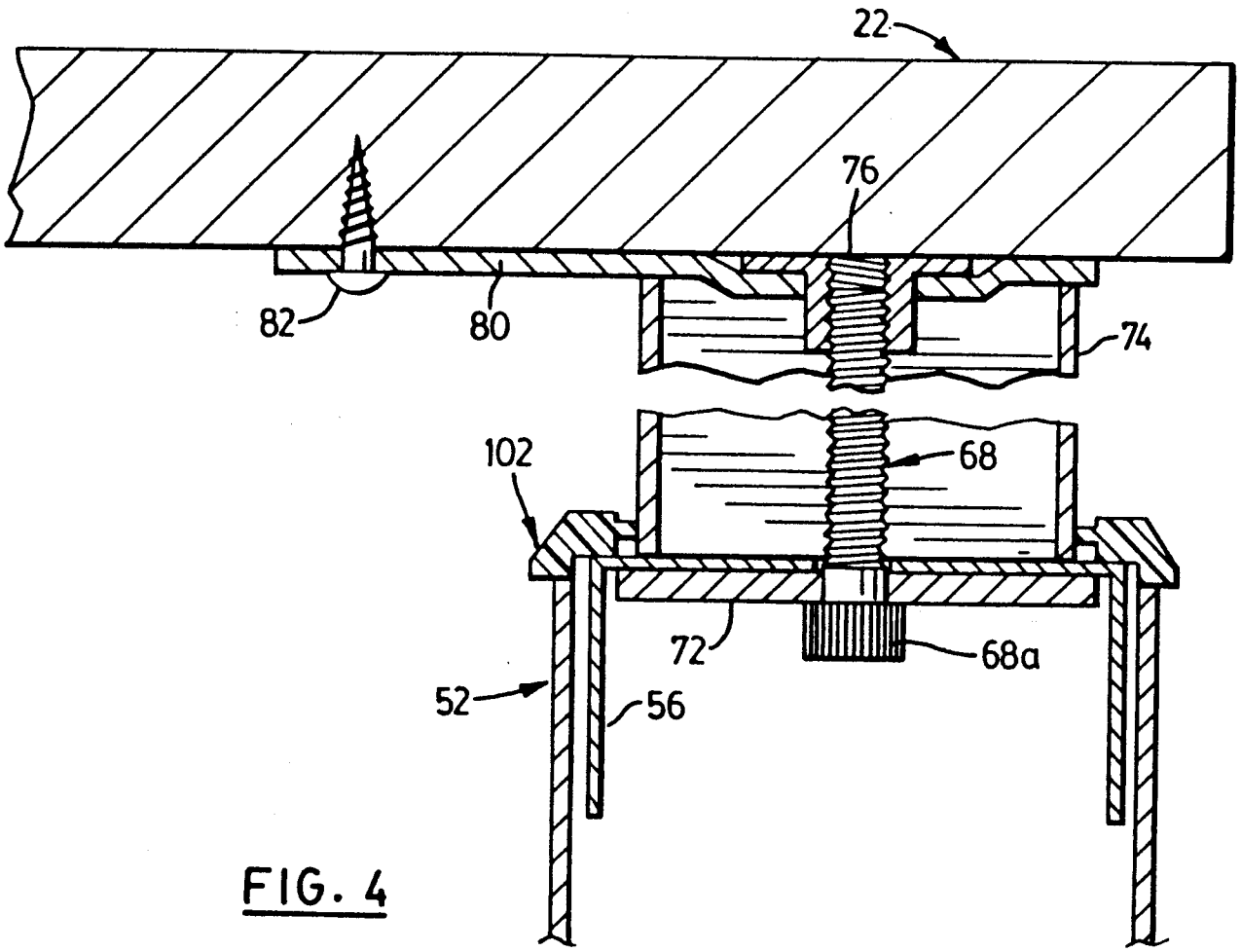
FIG. 4 is a sectional view on line 4—4 of FIG. 2.

A pair of bolts 68, 70 project upwardly from the top frame member 56 and are used to attach work top 22 to the gable. As best seen in FIG. 4, each of these bolts is installed from below the member with its head (as 68*a*) against an internal reinforcement plate 72. In the assembled desk, the two bolts 68, 70 extend through a spacer member 74 (see also FIG. 2) and are threaded into captive nuts 76, 78 in a plate 80 that is secured by screws (as screw 82) to the underside of the work top. A similar arrangement is of course provided at the top of gable 26 for supporting the other end of the work top but this supporting arrangement has not be illustrated in FIG. 3.

It will be appreciated that the height of the work top can be set as required by the choice of the length of the bolts 68 and 70 and the height of spacer 74. Also, spacer 74 can be replaced by a mechanical slide device or elevating arrangement if the work top is required to be movable.

A pair of adjustable feet 84, 86 are provided at corresponding locations in the bottom frame member 58 and are arranged to extend through and be threaded into captive nuts welded to the inside of the bottom of member 58. The nut for foot 86 is visible in FIG. 2 at 88.

The two gables 26, 28 are designed to permit easy attachment of various cladding panels and corner pieces that can be used to "tailor" the appearance of the desk to any particular customer's requirements. For example, wood or wood veneer cladding can be used where a traditional desk appearance is required whereas in other cases appropriately coloured and possibly textured plastic or metal cladding can be used. While the cladding can be permanently attached to the structural unit of the gable, the cladding is preferably removable so that it can be changed, for example to change the appearance of the desk or to replace a damaged panel or cladding piece. For this purpose, the top and bottom members 56, 58 and the uprights 52, 54 are provided with various openings to receive fasteners carried by the cladding panels. Some of those openings are indicated in FIG. 2 by reference numeral 90. Similar openings and cladding will be provided for gable 26 but have not been shown in FIG. 3.

In the particular embodiment illustrated, gable 28 (FIG. 2) is provided with inner and outer cladding panels as well as with edge and corner trim panels. The inner panel is shown at 92 and in this case takes the form of a generally square plastic panel provided on its inner face with a series of serrated plastic pins 94 that are designed to be snap-fitted and frictionally retained within corresponding ones of the openings 90 in the face of the structural unit of gable 28 that is at the rear in FIG. 2. In other words, panel 92 is simply snap-fitted in place. It will be noted that the panel is provided with a rectangular opening 96 for accommodating the beam 30. The corresponding panel for the outer face gable 28 is shown partly in ghost outline at 98 and is attached in similar fashion.

Cladding is also provided on all four edges of the gable. This cladding takes the form of extruded plastic trim strips having a suitable decorative external finish. The four trim strips for the four edges of the gable are indicated at 100, 102, 104 and 106 in FIG. 2. Each strip has at its inner face a channel slidably receiving a number of serrated fasteners that are similar to the fasteners 94 of panel 92. The channel is denoted 108 in the case of trim strip 104 and three fasteners for that channel are indicated individually at 110. These fasteners push-fit into openings in the structural unit in the same fashion as pins 94. It will be seen that the top trim panel 102 is provided with a rectangular cut-out 112 to accommodate spacer 74.

Corner trim is provided by respective corner caps that are clipped to the corner regions of the metal structural unit. The cap for the top left-hand corner of the unit is shown in an exploded position at 114. Cap 114 is a plastic moulding that is secured by adhesive to a metal clip 116 that grips into openings 90 adjacent the corner of the unit.

FIG. 3 shows beam 30 in perspective. The specific cross-sectional shape and construction of the beam is shown in detail in FIGS. 6 and 6*a*. The beam is essentially a box-section steel beam. It will be appreciated that, when the member is rigidly coupled to the steel fabricated end gables 26 and 28, the resulting assembly will be an extremely strong and rigid "chassis" or skeleton frame that will form a very strong and rigid desk structure. Referring now more specifically to FIG. 6, it will be seen that the beam is made up of an outer metal channel 118 that is generally of a reverse, angular C-shaped section as seen in FIG. 6. In other words, channel 118 has a back limb 118*a*and top and bottom limbs 118*b* and 118*c* respectively, continuations of which extend parallel to back limb 118*a* as indicated at 118*d* and 118*e* and form front surface portions of the beam (see FIG. 3). A partition member 120 (FIG. 6) is welded between the back limb 118*a* and the lower margin of the front limb portion 118*d* to divide the interior of the beam into the two wiring channels 32 and 34 referred to previously. Telecommunications and computer wiring in the lower channel 34 is indicated schematically at 38 while electrical wiring in the upper channel is indicated schematically at 36. Member 120 provides an electrical "screen" between the two channels.

A standard, commercially available electrical receptacle unit 122 is supported by an internal bracket 124 within channel 32 so that receptacles 122*a* of the unit are accessible from the front face of beam 30. In FIG. 3, the receptacle unit 122 is shown in an exploded position outwardly of the front face of beam 30, whereas the receptacle unit is shown in FIG. 6 installed in the beam. It will be seen from FIG. 3 that a rectangular recess 126 is formed in the front limb portion 118*d* of beam channel 118 to receive receptacle unit 122 and its supporting bracket 124. FIG. 3 also shows a trim panel 128 that is designed to snap into opening 126 and to fit snugly around receptacle unit 122 when the receptacle unit is installed to the beam. Receptacle unit 122 is designed to accept standard plug-in connectors which are provided on appropriate terminal portions of the electrical wiring set 36 in channel 32. In FIG. 3, two plug-in connectors are denoted respectively 130 and 132 and plug into opposite ends of unit 122. Similar connectors are provided on terminal portions of wiring set 36 at the ends of beam 30, for example as indicated at 134, so that wiring set 36 can be connected to a supply or to similar wiring sets in other desks. This allows wiring for a complete office layout to be run entirely "through" the desks.

Wiring channel 34 has a continuous open slot 136 along its front face. As can be seen from FIG. 3, slot 136 extends from end to end of the beam and is provided with a cover plate 138 (only part of which is shown). Cover plate 138 is provided with openings, as opening 140, through which computer and telecommunications wiring can be led from channel 34 as generally shown at 142. Cover plate 138 is in fact a plastic extrusion that is designed to snap-fit within the portions of channel 118 that define slot 136. Thus, it will be seen from FIG. 6 that plate 38 is provided on its inner face with a pair of outwardly directed hook-shaped formations 144 and 146 that are designed to snap over marginal portions of channel 118 along opposite edges of slot 136. FIG. 6*a* shows plate 138 fully fitted to the beam while FIG. 6 shows the plate in an intermediate position with its lower formation clear of the top edge of channel limb portion 118*e*.

Both ends of beam 30 are fitted with end plates such as the plate which is denoted 148 in FIG. 3; a corresponding plate at the opposite end of the beam is shown in FIG. 5 and is denoted 150. The end plates are both welded in place and formed with wiring access openings that match the wiring access openings 40 in the end gables (see FIGS. 2 and 3). For example, the wiring access openings in end plate 150 are denoted 152 and are shown in juxtaposition to the corresponding wiring openings 40 in gable 26. It will also be seen that the end plate is provided with a pair of captive headed studs 154 and 156 that are designed to be received in the keyhole shaped openings 64 and 66 respectively in end gable 26. The keyhole shaped openings and captive studs form the "coupling means" between the beam and the gables. The beam can simply be coupled to any particular gable by inserting the heads of the studs 154, 156 through the wide upper ends of the keyhole shaped openings 64, 66 as indicated by the arrows 158 and 160 in FIG. 5, and then moving the beam downwardly to bring the studs into the narrow sections of the openings. The length of each stud beneath its head is selected to correspond closely to the depth of the openings 64, 66 so that the beam is firmly and snugly coupled to the gable with minimum free play between the two components. Similar headed studs are of course provided at both ends of the beam (see the studs 162 and 164 of FIG. 3).

Figure 11:
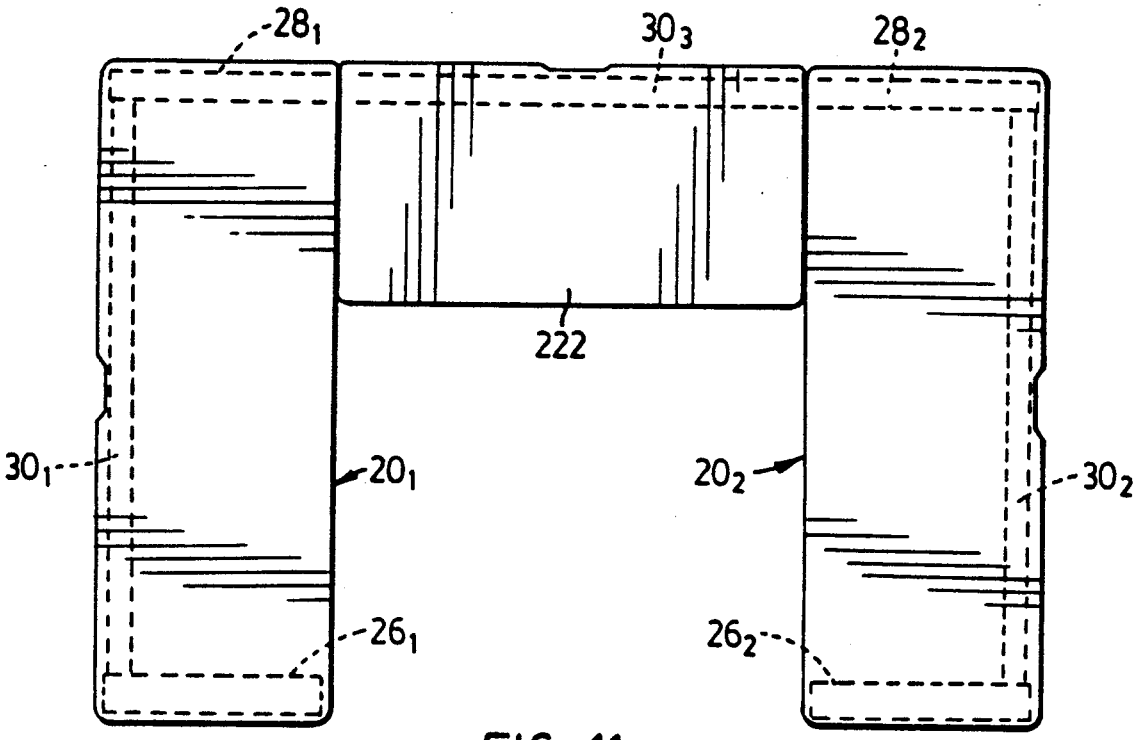
FIGS. 11 and 12 are schematic plan views illustrating two typical alternate work station layouts that are possible with the desk system of the invention.
Figure 12:
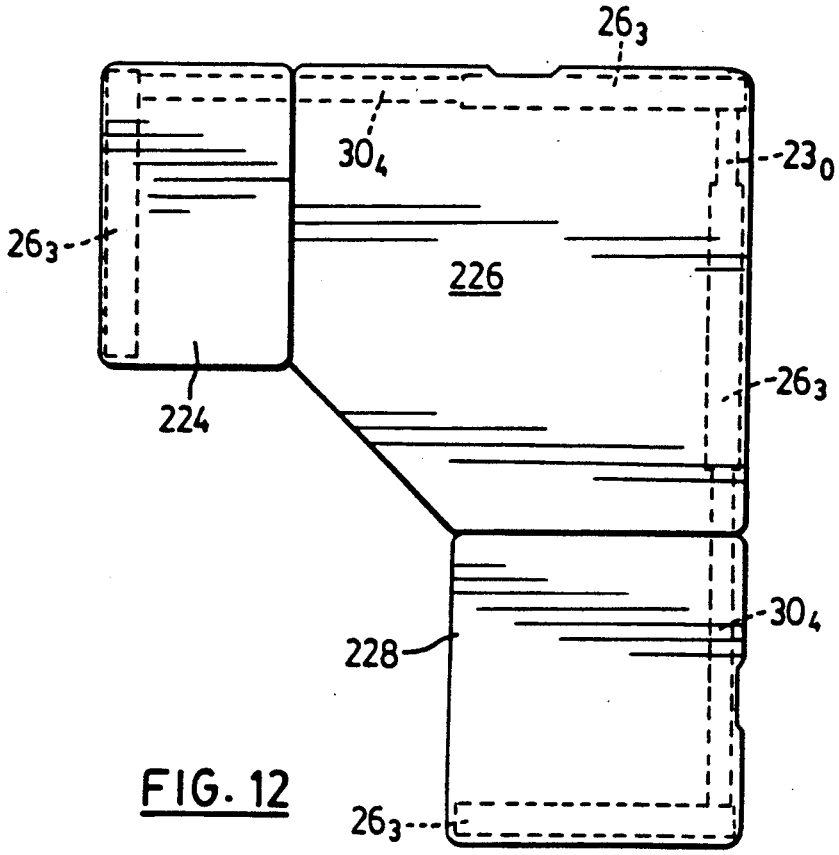

Short "dummy" sections of beam are provided as part of the overall desk system to serve as connectors between the two desks that ar to be coupled together either in alignment with one another or at right-angles (see FIGS. 11 and 12). These connectors will be essentially identical with but shorter than a full length beam, as member 30, but will otherwise be identical. Wiring can be led through this type of connector in the same way as a full length beam. A connector section will not normally (but could be) provided with an electrical receptacle unit.

Figure 7:
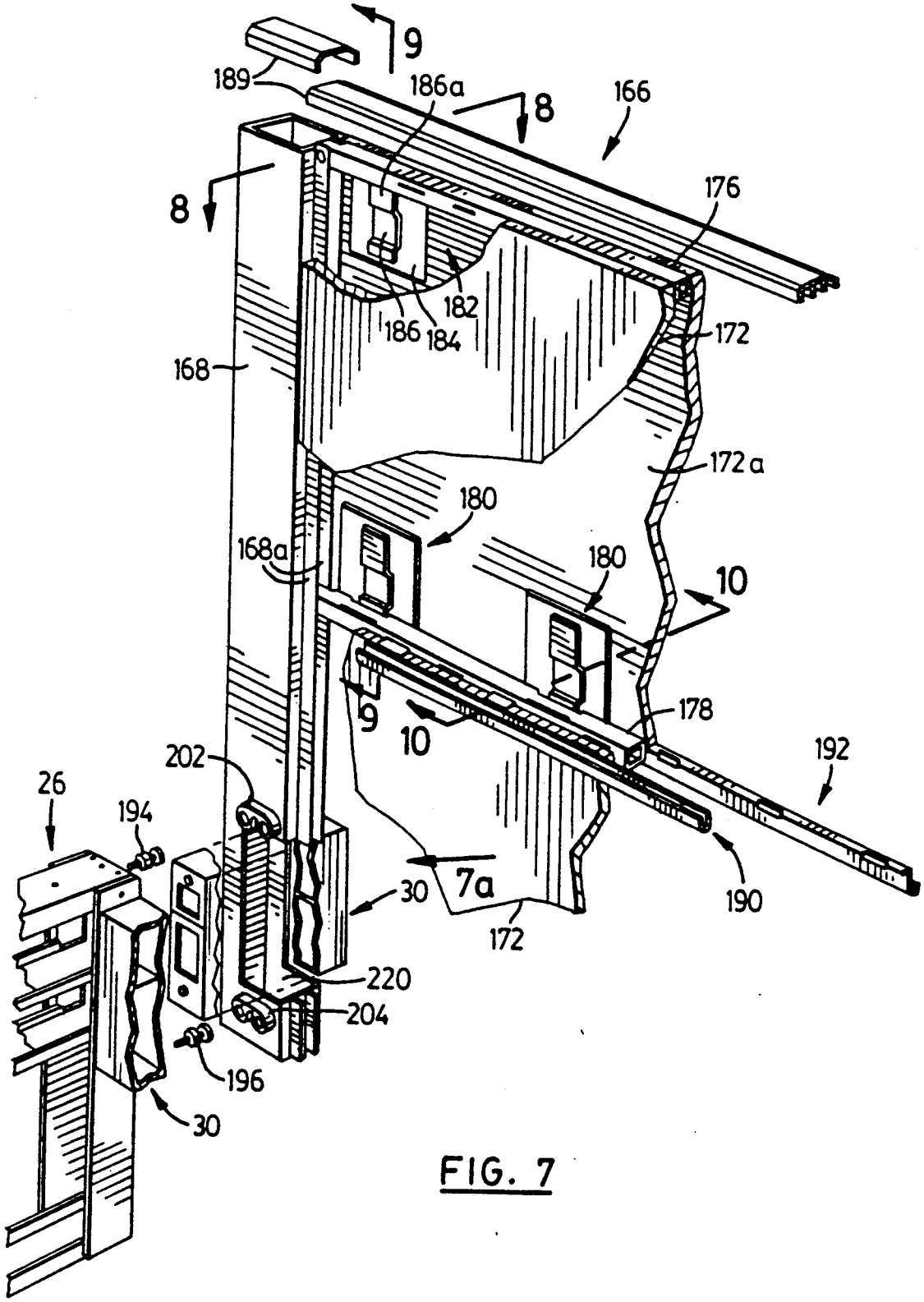
FIG. 7 is a perspective view partly exploded and partly broken away to show details of the screen of FIG. 1 and its method of coupling to the desk.
Figure 8:
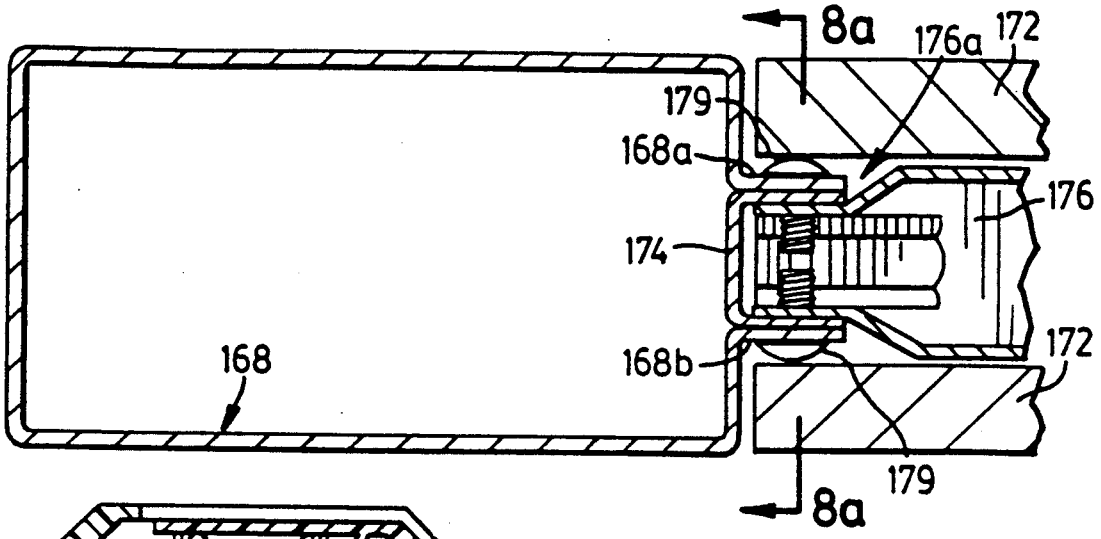
FIGS. 8, 9 and 10 are cross-sectional views on the section lines that are correspondingly designated in FIG. 7.
Figure 8A:
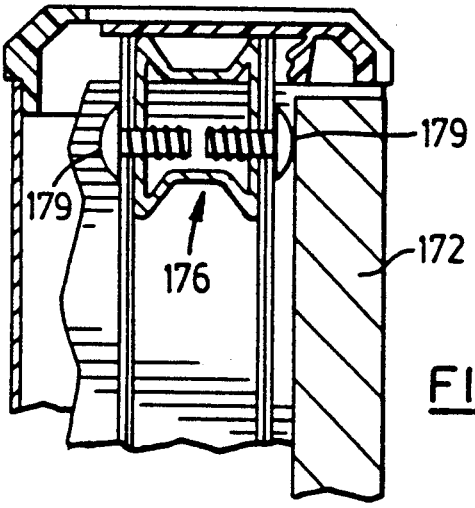
FIG. 8*a* is a sectional view on line 8*a*–8*a* of FIG. 8.

FIG. 1 shows a screen assembly 166 coupled to desk 20. The screen assembly includes a pair of upright posts 168 and 170 and a series of screen panels 172 that extend horizontally between the posts at both sides of the screen. As can best be seen from FIGS. 7 and 8, each post is essentially a box-section metal member but with a pair of projecting flanges extending vertically along its inner edge. The left-hand post 168 is shown in FIGS. 7 and 8 and the two flanges are denoted respectively 168*a* and 168*b*. Post 170 is of course similar. A channel-shaped spacer 174 maintains the two flanges at an appropriate spacing (see FIG. 8).

Extending between the two posts 168 and 170 at vertically spaced positions corresponding to the height of the screen panels 172 are a series of horizontal cross bars, two of which are shown in FIG. 7 at 176 and 178 respectively. It can be seen that each bar is a box section metal member. At each end, each bar is compressed laterally as best seen in FIG. 8 to fit between the two post flanges 168*a*, 168*b* and within spacers 174. As seen in FIG. 8, the compressed end portion of cross bar 176 is denoted 176*a*. Sheet metal screws 179 are used to secure the cross bar to the flanges and spacer. This fastening arrangement is used at both ends of each cross bar.

Figure 9:
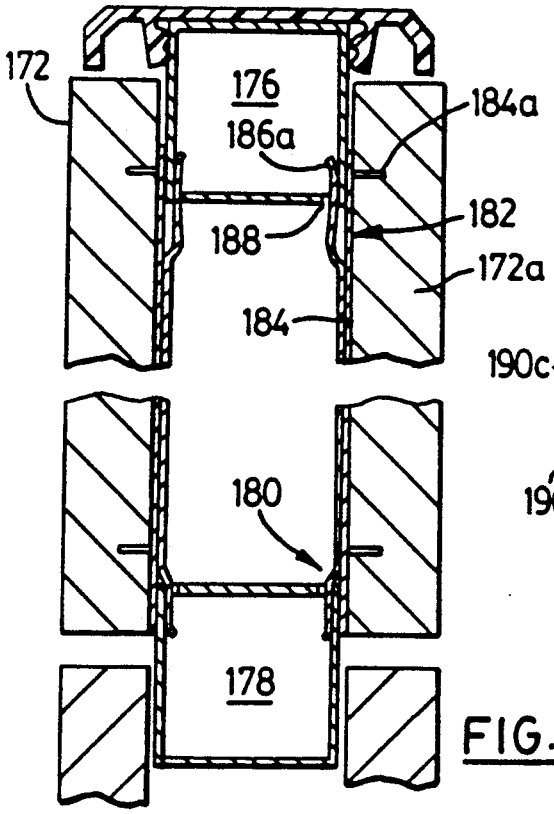

The screen panels 172 may take different forms and have different surface finishes depending on the particular style of the office in which the furniture is to be used. In the drawings, each panel is shown as a lightweight fibre board panel. The panels are removably coupled to the cross bars (as 176 and 178) by a series of clips along each of the upper and lower marginal portions of each panel. In FIG. 7, one of the panels is denoted 172 and is shown provided on its inner surface adjacent its bottom margin with a pair of clips 180. One of a number of similar clips adjacent the upper margin of the same panel is denoted 182. Referring to this latter clip by way of example, it will be seen that it comprises a base plate 184 which is secured to the panel and a clip member 186 which is carried by the base plate. The clip member 186 has an outer limb 186*a* that is displaced laterally away from base plate 182 and the upper end portion of which is received in a slot in the underside of cross bar 176. In FIG. 9, cross bar 176 is shown in section and the slot that receives clip limb 186*a* is denoted 188. Clip 180 is also visible in FIG. 9 and is essentially the same as clip 182 but inverted so that its cross bar engaging limb projects downwardly through a slot in the top of cross bar 178. FIG. 9 also shows at 184*a* one of a pair of tangs on base plate 184, which penetrate the panel and secure the clip thereto.

Panel 172*a* is fitted to the cross bars by first raising the panel to engage the limbs of the upper clips (as clip 182) with the slots in the lower wall of cross bar 176. The lower margin of the panel is then swung inwardly and the panel is lowered so that the clip limbs of the lower clips engage the slots in the top of cross bar 178. It will be appreciated that this design allows the panels to be easily and quickly inserted and removed and further that any one panel can be removed without affecting any other panel. This allows the screen to be constructed with a "see through" space.

Extruded plastic trim pieces 189 are applied to the tops of posts 168 and 170 and to cross bar 176 as shown in FIG. 7.

Figure 10:
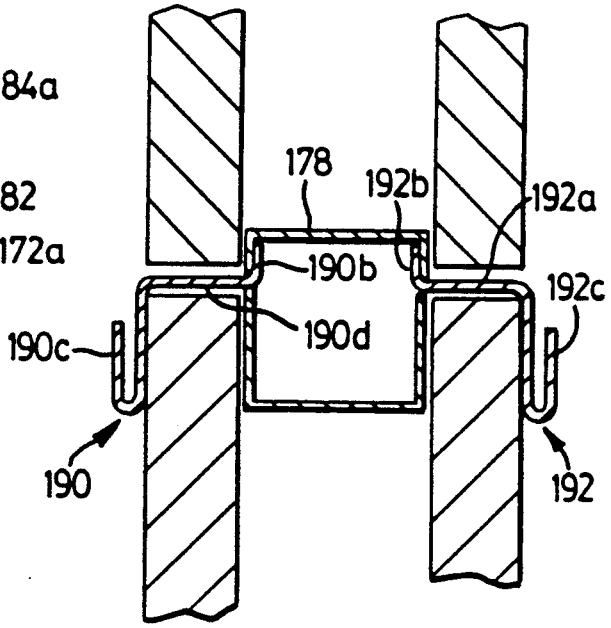

FIG. 10 shows two accessory hangars 190 and 192 engaged in slots in the sides of cross bar 178. It will be seen that the two clips have horizontal limbs 190*a* and 192*a* that extend horizontally between vertically adjacent panels, and respective inner limbs 190*b* and 192*b* that hook inside the cross bar. Outwardly of the panels, the two hooks have J-shaped portions 190*c* and 192*c* that are accessible from externally of the screen so that accessories such as filing cabinets, hangers and the like can be hung from the screens. The two hooks 190 and 192 are continuous and extend over the full width of the screen between the posts. In FIG. 1, hook 190 is visible above the bottom panel 172. It will be appreciated that the hooks can be installed and removed at any desired location without removing the screen panels.

The two posts 168 and 170 are coupled to the end gables of the desk "chassis" so that the screen is rigidly and firmly supported. FIG. 7 shows the manner in which post 168 is connected to end gable 26. As can be seen from that view, a pair of headed studs 194, 196 are threaded into captive nuts in the end of the gable. Referring back to FIG. 2, typical holes to receive those studs are indicated at 198 and 200; similar holes are provided on all three exterior faces at each end of the gable. A captive nut is provided behind each hole.

Referring back to FIG. 7, a pair of "keepers" corresponding to the two threaded studs 194 and 196 are secured to the lower end portion of the post and are denoted by reference numerals 202 and 204. One of these keepers and the associated headed stud are shown individually in FIG. 7*a* and are considered as being stud 194 and keeper 202. It will be seen that the keeper 202 is secured to the post by a pair of bolts 206, 208 and that the keeper has on its inside face a recess 210 to accommodate the head 212 of the stud 194. Outwardly of the recess is a shoulder 214 that fits behind the head of the stud and extends on opposite sides of a slot 216 that fits over the stud neck 218 inwardly of head 212.

It will be appreciated that, when keeper 202 is engaged with stud 194 (and the other keeper 204 is similarly engaged with stud 196) post 198 will be firmly and securely supported and retained on the gable of the desk chassis. Thee keeper and stud are of course sized to close tolerances so that the posts can be reasonably easily attached to the gables while at the same time allowing minimum free movement of the posts on the gables in the assembled desk.

The screen posts (as posts 168 and 170) may be straight and uninterrupted, for example where a screen is to be directly attached to a single desk as in FIG. 1. However, FIG. 7 shows that the posts can be recessed, for example at 220 to accommodate a desk beam 30 or a connector of the form discussed above. FIG. 7 also illustrates the fact that the screen posts 168 and 170 terminate well clear of the floor on which the desk stands; this is done deliberately to allow good air circulation below screen 166.

Finally, FIGS. 11 and 12 illustrate two alternative desk configurations that may be achieved using the desk structure of the invention. It is of course to be understood that these are examples only and that complete office work station systems may be assembled in many different configurations from various combinations of gables and beams of the form described above.

It is anticipated that the two different but standard sizes of gable and beam will be available (although more than two sizes could of course be provided) and that an additional short "dummy" beam section will be made for use as a connector as described previously. Referring for example to FIG. 11, the work station shown in that view is essentially a combination of two desks "back-to-back" with a suspended desk top between them. The two desks are denoted respectively $20_1$ and $20_2$ and the suspended top is denoted 222. The two desks each have two standard height but narrow gables $26_1$ and $28_1$ and $26_2$ and $28_2$ respectively. A standard beam $30_1$, $30_2$ extends between each pair of gables. A third beam $30_3$ extends between the end faces of the two gables $28_1$ and $28_2$ below the rear edge of top 222.

FIG. 12 shows a corner work station for a video display terminal and has three work tops 224, 226 and 228 together supported by four identical gables, each denoted $26_3$. It will be seen that each of these gables is somewhat wider than the gables shown in FIG. 11 (but the height will be the same). Two shorter beams individually denoted $30_4$ are used together with a short connector 230.

Amongst other possible configurations that may be achieved, a standard desk of the form shown in FIG. 1 may of course be provided with a return by adding a beam section to the end of one of the gables 26, 28 and an additional gable at right angles to the additional beam, as generally indicated in ghost outline at 232 in FIG. 1. An additional work top section (not shown) can then be supported on this additional beam and gable with the addition of additional brackets (not shown) to connect the additional work top to the existing work top 22.

It will be course be appreciated that the preceding description relates to a particular preferred embodiment of the invention only and that many modifications are possible within the broad scope of the invention.

For example, the specific forms of disconnectible coupling means described previously, while preferred, are examples only and may be varied. Also, these specific constructional features of the gables themselves may change.

I claim:

1. A desk comprising:

a work top having a work surface;

a structural frame supporting said work top and comprising: at least two spaced parallel gables disposed below respective end portions of said work top each said gable comprising a rigid structural unit including front and rear uprights; work top support means at an upper end of each said unit co-operating with a respective said work top end portion, whereby the work top is supported by said structural units; beam means extending between said gables at an outer edge of said work top and including at least one beam; and disconnectible coupling means between respective ends of said beam and the rigid structural units, said coupling means structurally connecting said beam and units to form said structural frame;

said beam defining at least two wiring channels which extend from end-to-end of the beam and which are electrically screened from one another, said channels being adapted to receive respective wiring sets and permitting access to said sets from a front face of said beam; said gables further including openings permitting communication with ends of said wiring channels from externally of the respective gables;

decorative cladding means comprising at least two cladding panels each overlying an outer face of one of said gables and providing a finished appearance to said gable; and, cladding attachment means between inner faces of said cladding panels and said outer faces of the gables, removably attaching said panels to said gables.

2. A desk as claimed in claim 1, wherein each said gable upright has three exterior faces respectively at inner and outer sides and an end of the gable, and wherein said coupling means comprise inter-engageable first and second coupling elements respectively on end faces of said beam and on each of said three exterior faces of said gable uprights, whereby said beam can be selectively coupled with said gable at any one of said three exterior faces of each said upright for varying the configuration of said desk, said gable upright exterior faces each being provided with said openings permitting communication with said wiring channels in the beam.

3. A desk as claimed in claim 2, wherein said first coupling elements comprise at least two headed studs projecting from each end face of said beam, and wherein said second coupling elements comprise corresponding keyhole-shaped slots adapted to receive said headed studs, said studs and slots being dimensioned with respect to one another so that the beam is rigidly coupled to a said gable and the studs are fully engaged in said slots.

4. A desk as claimed in claim 3, wherein each said gable comprises a welded assembly of metal channel members including at least first and second channel member pairs, the channel members in each pair being arranged with their channels facing one another, said first pair of channel members forming said uprights and said second pair of channel members extending between said uprights and forming top and bottom members of said frame, each channel member including a pair of side limbs and a base.

5. A desk as claimed in claim 4, wherein said keyhole slots are formed in portions of the side limbs and base of both of the channel members of said first pair, adjacent upper ends of said uprights.

6. A desk as claimed in claim 1, wherein said beam is a generally box-section metal member having internally a partition which divides the interior of said beam into upper and lower compartments extending from end to end of the beam and forming said wiring channels, said partition member being made of metal and providing said electrical screening.

7. A desk as claimed in claim 6, wherein one said wiring channel is designated to receive an electrical wiring set and the other channel is designated to receive a telecommunications wiring set, and wherein the beam further includes at least one electrical receptacle installed in a front face of said beam in communication with said electrical wiring channel, the other said channel having a continuous longitudinal opening in a front face of said beam and being provided with a removable trim panel normally closing said opening.

8. A desk as claimed in claim 6, wherein each end of said beam is provided with an end plate having openings to accommodate wiring sets within said channels, and wherein said coupling means comprises inter-engageable coupling elements comprising first said elements on said end plates of the beam and second said elements on said gables.

9. A desk as claimed in claim 1, further comprising a including a pair of upright screen posts coupled to said gables and at least one screen panel extending generally horizontally between said posts.

10. A desk as claimed in claim 9, further comprising disconnectible coupling means between each said post and the relevant said gable, each said coupling means comprising a headed stud on one of said post and gable and a corresponding keeper on the other of said post and gable, said stud and keeper being inter-engageable and arranged to vertically support said post.

11. A desk as claimed in claim 9, further comprising at least one pair of cross bars extending between said posts respectively at upper and lower edges of said screen panel, and a plurality of clips along upper and lower marginal portions of said panel releasably coupling the panel to the respective cross bars.

12. A desk as claimed in claim 11, further comprising, in association with at least one of said cross bars, an accessory hangar removably engaged with said cross bar and including a portion that extends outwardly of said bar through a horizontal joint between any vertically adjacent screen panels coupled to said bar, said hangar including an elongate hook-shaped section which is accessible from externally of the screen and with which accessories can be engaged for suspension from said screen.

13. In an office furniture system which includes at least one desk, the improvement wherein said desk comprises:

a work top having a work surface;

a structural frame supporting said work top and comprising: at least two spaced parallel gables disposed below respective end portions of said work top, each said gable comprising a rigid structural unit including front and rear uprights; work top support means at an upper end of each said unit co-operating with a respective said work top end portion, whereby the work top is supported by said structural units; beam means extending between said gables at an outer edge of said work top and including at least one beam; and disconnectible coupling means between respective ends of said beam and the rigid structural units, said coupling means structurally connecting said beam and units to form said structural frame;

said beam defining at least two wiring channels which extend from end-to-end of the beam and which are electrically screened from one another, said channels being adapted to receive respective wiring sets and permitting access to said sets from a front face of said beam; said gables further including openings permitting communication with ends of said wiring channels from externally of the respective gables;

decorative cladding means comprising at least two cladding panels each overlying an outer face of one of said gables and providing a finished appearance to said gable; and, cladding attachment means between inner faces of said cladding panels and said outer faces of the gables, removably attaching said panels to said gables.

14. A structural frame for a desk comprising: two gables, each in the form of a rigid structural unit including front and rear uprights; work top support means at an upper end of said unit for co-operation with a work top of said desk, whereby said work top can be supported by said two gables with each gable disposed below an end portion of the work top; a beam extending between said gables; and disconnectible coupling means comprising inter-engageable first and second coupling elements respectively on both ends of said beam and on said rigid structural units, said coupling means being adapted to structurally connect said beam and units to form said structural frame; said beam defining at least two wiring channels which extend from end-to-end of the beam and which are electrically screened from one another, said channels being adapted to receive respective wiring sets and permitting access to said sets from a front face of said beam; said gables further including openings permitting communication with ends of said wiring channels from externally of the respective gables; and means on at least outer faces of the respective gables to co-operate with external cladding panels for attaching said panels to said outer faces of the respective gables and providing a finished appearance to said gables.

* * * * *